United States Patent [19]

Webb et al.

[11] Patent Number: 4,490,461

[45] Date of Patent: Dec. 25, 1984

[54] PROCESS FOR THE PREPARATION OF PHOTOGRAPHIC MATERIALS

[75] Inventors: Terence C. Webb, Wilmslow; Peter A. Lovell, Altrincham; Samuel B. Kingston, Wilmslow, all of England

[73] Assignee: Ciba-Geigy AG, Basel, Switzerland

[21] Appl. No.: 512,823

[22] Filed: Jul. 11, 1983

[30] Foreign Application Priority Data

Jul. 23, 1982 [GB] United Kingdom ..... 8221360

[51] Int. Cl.[3] ..... G03C 1/84; G03C 7/26; G03C 1/02

[52] U.S. Cl. ..... 430/510; 430/449; 430/543; 430/566; 430/627; 430/631

[58] Field of Search ..... 430/566, 546, 138, 631, 430/627, 449, 507, 510, 543; 525/374, 375, 326.8; 106/308 M

[56] References Cited

U.S. PATENT DOCUMENTS

| | | | |
|---|---|---|---|
| 2,852,383 | 9/1958 | Kenyon et al. | 430/548 |
| 3,451,820 | 6/1969 | Umberger | 430/449 |
| 4,241,163 | 12/1980 | Myers et al. | 430/223 |
| 4,283,474 | 8/1981 | Kaneko et al. | 430/87 |
| 4,340,664 | 7/1982 | Monbaliu et al. | 430/449 |

*Primary Examiner*—Mary F. Downey
*Attorney, Agent, or Firm*—Joseph G. Kolodny

[57] ABSTRACT

Process for the preparation of a photographic material comprising in at least one layer photographic useful compounds, e.g. color couplers or developers, which are occluded into solid polymer particles of 0.1 to 0.5 μm in size.

14 Claims, No Drawings

PROCESS FOR THE PREPARATION OF PHOTOGRAPHIC MATERIALS

This invention relates to a process for the preparation of photographic materials comprising at least one layer which contains a PU compound.

Most photographic materials comprise at least one colloidal silver halide layer coated on a photographic support. Often it is required to include in the silver halide layer or in another layer of the material a compound which affects the photographic properties of the silver halide, which aids in the formation of the image or which affects the properties of the image. Such compounds are hereinafter referred to as a photographically useful compound which is shortened to PU compound.

Some PU compounds, for example developing agents such as hydroquinone, are of small molecular size and if coated in a layer of the photographic material will migrate from this layer to other layers of the material and during processing cause unwanted reactions and stain in these other layers. Thus it is important to render such small molecular weight compounds layer substantive. Some attempts have been made to turn such small molecular weight PU compounds into protected PU compounds which are often layer substantive but which require to be hydrolysed, usually during a process step, to render them active. But such a hydrolysis step means that the PU compounds often cannot act as quickly as is desired. Other PU compounds such as colour couplers are of relatively high molecular weight. Often these compounds are water-insoluble and in order to include them in photographic layers it is necessary to dissolve them in so-called oil formers such as dibutyl phthalate and to disperse the oil solution of the PU compounds in the photographic layer. However, the presence of comparatively large quantities of oil in photographic layers causes problems in coating of the layers and also leads to soft layers which can produce difficulties when the photographic material is finished, that is to say cut into strips, perforated and packed into cassettes.

It was now found that PU compounds can be incorporated into photographic materials in a layer substance manner without using oils or oil formers.

Therefore, it is one object of the present invention to provide a process for the preparation of a photographic material which comprises at least one layer containing a PU compound, which process comprises forming a solution of a PU compound, a compound capable of being cross-linked and a cross-linking agent for the cross-linkable compound to form a cross-linked solid, isolating the solid and milling the solid to form particles of 0.1 to 0.5 μm in size, dispersing the particles in a colloid binder coating solution, coating this solution on a photobase and drying the layer.

Another object of the present invention is the photographic material obtained by this process. These and other objects of the present invention will be apparent from the following detailed description.

Most usually the colloid binder coating solution is a gelatino silver halide emulsion.

Preferably, the milling of the solid is carried out in the presence of an aqueous solution of a colloid binder, for example gelatin. Thus, the milling process produces a dispersion of the particles in an aqueous solution of the colloid. This allows easier mixing of the particles in the aqueous colloid coating solution.

Preferably, the pH-value of the aqueous medium used during the milling is kept below 7 in order to prevent the solid particles swelling. It is to be understood that the terms 'compound which can be cross-linked and cross-linking agent for said cross-linkable compound' include the use of a compound which can self-cross link to form a cross-linked mass. Such a compound is for example hexamethylol melamine hexamethyl ether. The use of this compound alone in the process of the present invention is illustrated in Preparation XII which follows.

Examples of PU compounds of small molecular weight are developing agents (silver halide and colour developing agents) including hydroquinone, 1-phenyl-3-pyrazolidinone, p-N-methyl-aminophenol sulfate, N-parahydroxyglycine (glycin), 2,4-diaminophenol dihydrochloride (amidol), 2-N-4-amino-m-tolylethyl-amino ethanol and N-n-butyl-N-(4-sulpho-n-butyl)-p-phenylen-diamine as well as antifoggants for example 1-phenyl-mercapto-tetrazole.

Examples of PU compounds of larger molecular weight are colour couplers, preferably those described in GB No. 2 011 398A, GB No. 1 513 832, GB No. 1 566 618 and GB No. 1 574 222, optical brightening agents, such as those described in Venkataraman, Vol. V, Chapter V111, Academic Press, further acutance dyes, for example tartrazine, and filter dyes, for example bispyrazolone derivatives such as benzyliden-bispyrazolone compounds.

Any cross-linking reaction may be used in the process of the present invention as long as the PU compound is soluble in a solution which comprises both the cross-linkable compound and the cross-linking agent and does not affect the cross-linking reaction. Further, the cross-linked solid must be grindable to obtain a particle size of from 0.1 to 0.5 μm and most preferably of from 0.2 to 0.3 μm. Some cross-linking reactions yield a solid which is too soft to grind to form particles and some cross-linking reactions yield a solid which is too hard and thus impractical to grind to the required particle size.

In some cases a further heaat-treatment of the cross-linked solid after it has been formed yields a solid which is more readily grindable. Further, it can improve the substantivity of the occluded PU compound. In the process of the present invention the PU compound is locked into the solid mass formed by the cross-linking reaction. During the photographic developing process which is usually carried out under alkaline conditions the dispersed particles which contain the PU compound swell and if the PU compound is of small molecular weight the PU compound is liberated from the particle. However, if the PU compound is of higher molecular weight, for example a colour coupler, a compound which is present in the alkaline processing solution is able to penetrate the particles and react with the PU compounds contained therein. For example a colour developing compound is able to enter the particles and react with colour couplers contained therein to form a dye.

Examples of useful processes which are inventively carried out in the presence of cross-linking agents are solution polymerisation, suspension polymerisation and photopolymerisation processes.

One solution polymerisation process for the preparation of a photographic material which comprises a layer containing a PU compound, comprises forming a solution of a PU compound, a compound capable of being cross-linked and a cross-linking agent for said cross-linkable compound, effecting cross-linking by raising the temperature of the solution to drive off the solvent and form a cross-linked solid, optionally continuing the heating to effect a higher cross-link density, milling the solid to form particles of 0.1 to 0.5 μm in size, dispersing the particles in a colloid binder coating solution, coating this solution on to a photobase and drying the layer.

In this process often a solid lump of material is formed which requires to be broken up before it can be ground to yield then requisite size particles. However, in another form of solution polymerisation wherein the polymerisation is carried out in an inverse suspension particulate solid material is formed which facilitates isolation of the solid and also the milling step.

Thus, in this aspect of the present invention there is provided a process for the preparation of a photographic material containing a PU compound which process comprises forming a solution of a PU compound, a compound capable of being cross-linked and a cross-linking agent for said cross-linkable compound in a first liquid, dispersing this solution in an immiscible second liquid which has a higher boiling point than said first liquid, effecting cross-linking by raising the temperature of the dispersion to drive off the first liquid and form a cross-linked solid in particulate form, optionally continuing the heating to effect a higher cross-link density, isolating the solid, milling the solid to form particles in a colloid binder coating solution, coating this solution on to a photobase and drying the layer.

An example of a useful first liquid in which the ingredients can be dissolved is water and an example of a useful second liquid, which is immiscible in water but whch has a higher boiling point than water is xylene.

Other useful pairs of liquids are water, together with toluene or with tetralin. A non-aqueous pair of liquids which can be used in methanol and cyclohexane.

In the above two solution polymerisation processes, sometimes it is preferred to continue to heat the solid left after all the solvent has evaporated. This extra heating can lead to a high cross-link density of the solid as described, for example, in preparation 1 which follows. In some cases, however, continued heating after the solid mass has been obtained on evaporation of the solvent leads to a marked discolouration of the mass. This often indicates that the PU compound has begun to decompose and this could lead to adverse photographic effects for example the production of a high level of fog in the processed material, if such a solid were incorporated in photographic material.

A particularly useful group of compounds which can be cross-linked in solution polymerisation processes are resin polymers or copolymers which have pendant —OH, —$CONH_2$, —COOH or $$-\overset{O}{\overset{\|}{C}}-O-\overset{O}{\overset{\|}{C}}-$$

groups. Preferably these compounds are cross-linked in acid conditions. Thus in the above solution processes using these compounds preferably they together with a cross-linking agent are dissolved in an aqueous or organic solvent and the solution is acidified. The PU compound is then added and cross-linking is carried out as before.

A particularly useful class of copolymers which have pendant —COOH groups are copolymers of an ethylenically unsaturated monomer and a copolymerisable acid for example acrylic acid, methacrylic acid, itaconic acid or maleic acid.

Examples of copolymers which have pendant $$-\overset{O}{\overset{\|}{C}}-O-\overset{O}{\overset{\|}{C}}-$$

groups are copolymers of an ethylenically unsaturated monomer and a copolymerisable anhydride for example maleic anhydride and the cross anhydride of methacrylic acid and acetic acid.

Particularly useful ethylenically unsaturated monomers are alkyl acrylates and alkyl methacrylates. Other suitable monomers are styrene and acrylonitrile.

Preferably the copolymer comprises 70 to 90% by weight of the ethylenically unsaturated monomer and 10 to 30% by weight of the copolymerisable acid or anhydride.

Especially useful copolymers are copolymers of ethyl acrylate and acrylic acid and methyl methacrylate and methacrylic acid.

Most preferably the alkylacrylate or methacrylate comprises 85% by weight of the copolymer and the acid or anhydride 15% by weight of the copolymer.

Copolymers of an acrylate or methacrylate and a copolymerisable acid or anhydride are water insoluble but are soluble in organic solvents for example ethanol.

Another useful class of copolymers which have pendant —COOH groups are alkyl resins which are condensation products of glycerol and bifunctional carboxyl group containing compounds for example phthalic acid, isophthalic acid, terephthalic acid, maleic acid, malonic acid and succinic acid. Especially useful acids are phthalic and maleic acid.

Useful polymers which comprises pendant —COOH groups are carboxylated starch and cellulose derivatives for example carboxymethyl cellulose.

A useful class of a polymer which has pendant —OH groups is hydrolysed polyvinyl acetate.

Also both water-soluble and water-insoluble cellulose derivatives which comprise pendant —OH groups can be used. Examples of such cellulose derivatives are methyl cellulose and ethyl cellulose which are water soluble and nitrocellulose, cellulose acetate and cellulose acetate-butyrate which are organic solvent soluble.

Another useful class of copolymers which comprise pendant —OH groups are copolymers which comprise units of hydroxy alkyl acrylate or methacrylate for example hydroxyethyl methacrylate or hydroxypropylacrylate and other ethylenically unsaturated monomers for example styrene, alkyl acrylates and alkyl methacrylates. Terpolymers are especially useful. Particularly useful are terpolymers which comprise styrene, alkyl methacrylate and hydroxyethylmethacrylate. Usually the amount of hydroxyalkyl acrylate or alkyl methacrylate present in the polymer is between 10 and 30% by weight.

A useful class of copolymers which comprise pendant —$CONH_2$ groups are copolymers of acrylamide or methacrylamide with an ethylenically unsaturated monomer for example an alkyl acrylate, alkyl methacrylate, styrene or acrylonitrile. The preferred monomers are alkyl acrylates and alkyl methacrylates for example ethyl acrylate and methyl methacrylate.

All the polymers and copolymers hereinbefore described can be cross-linked by use of well known cross-linking agents which react with free —OH, —COOH,

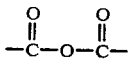

or —$CONH_2$ groups.

Examples of other compounds which comprise at least two methoxymethyl groups which are useful as cross-linking agents for the above mentioned polymers and copolymers are methylated urea-formaldehyde resins, methylated phenol-formaldehyde resins, and methylated melamine-formaldehyde resins.

Examples of useful cross-linking agents are compounds which comprise at least two methoxymethyl groups for example hexamethylol melamine hexamethyl ether, bismethoxymethyl-urea and bismethoxymethyl-uron, the preferred compound being hexamethylol melamine hexamethyl ether.

Other suitable cross-linking agents for use in this aspect of the invention are aziridines and acrylates functionalised with aziridines.

Other cross-linking agents which can be used in this aspect of the present invention are isocyanates and diglycidyl ethers. However, in certain cases, the solid mass thus formed is difficult to mill to small particle size.

As hereinbefore stated in the process of the present invention the solid mass may be formed by a self-condensation. In fact, all the compounds hereinbefore mentioned as cross-linking agents which comprise more than two methoxymethyl groups can self condense under certain conditions. Usually the presence of free acid is sufficient to catalyse self-condensation.

In practice the preferred compound which comprises at least two methoxymethyl groups which self-condense to form a solid mass for use in the process of the present invention is hexamethylol melamine hexamethyl ether.

The methylated phenol-formaldehyde, urea-formaldehyde and melamine-formaldehyde resins can also be used to self-condense to a solid mass but better results are obtained by using unmethylated phenol-formaldehyde, urea-fomaldehyde and melamine-formaldehyde resins. All these resins can be prepared in low molecular weight form to be water-soluble. Cross-linking is effected by addition of an acid to the aqueous solution of the copolymers. Preferably, formic acid is used as catalyst and the by-product formed by the condensation reaction is then water.

A type of copolymer which can be self cross-linked is a polymer which comprises pendant methoxymethyl groups, or pendant methoxymethyl groups and pendant —COOH groups.

Examples of such copolymers are terpolymers of an ethylenically unsaturated monomer, a copolymerisable acid and N-methoxymethylacrylamide or N-methoxymethylmethacrylamide.

Useful ethylenically unsaturated monomers for such copolymers are especially alkyl acrylates and alkyl methacrylates. Other suitable monomers are styrene and acrylonitrile.

Examples of copolymerisable acids are acrylic acid, methacrylic acid, itaconic acid and maleic acid.

Cross-linking is effected by addition of an acid to the aqueous solution of the copolymer.

A particular advantage of using copolymers of this type is that the copolymer is formed in solution in a solvent which can be used to dissolve the PU compound.

A useful addition reaction in the process of the present invention is the anionic polymerisation of a cyanoacrylate to form a solid when the inhibitor, oxygen, is removed.

An example of a cross-linking system which may be used in this aspect of the process of the present invention but which is not possible in the preferred process as just described in a system in which one component comprises at least two isocyanate pendant groups and the other component comprises —OH or —$NH_2$ pendant groups. As isocyanates are very reactive with water and a large number of organic solvents such a system can really only be used when the component which comprises the —OH or —$NH_2$ groups is also the solvent for the PU compound. For example the PU compound could be dissolved in glycerol and the glycerol then cross-linked with a diisocyanate for example tolylene diisocyanate.

Another cross-linking system which may be used in this aspect of the process of the present invention is one wherein one component comprises at least two epoxide groups or preferably an anhydride group, and the other component comprises at least two groups which can react with said epoxide or anhydride groups. Examples of suitable combinations are illustrated in "The Chemistry of Organic Film Formers", D. H. Solomon, pages 193–201.

Another cross-linking system which may be used in this aspect of the present invention is a system which comprises an ethylenically unsaturated monomer as the cross-linkable component and a dimaleimide (D.M.I.) compound as the cross-linking agent, for example the D.M.I. compounds described in European Patent application No. 21019. Optionally, in this cross-linking system, a copolymerisable acid monomer is also present.

D.M.I. compounds can be used to effect photo-cross-linking but in this case the D.M.I. compound, the monomers and the PU compound are dissolved in a suitable solvent, an initiator is added and cross-linking is effected at an elevated temperature in the dark. Thereafter the solution is light-exposed. This causes further cross-linking and the cross-linked solid is precipitated, water washed, dried and ground.

Preferably, a monomer mixture is used which comprises an acrylate or methacrylate monomer and a copolymerisable acid. A particularly useful mixture is methyl methacrylate and methacrylic acid. Other suitable monomers are styrene, vinyl acetate and methylated acrylamides. Other suitable copolymerisable acids are acrylic acid, itaconic acid and vinylsulphonic acid.

As an alternative to this system a pure photo-cross-linking reaction can be perforemd.

Therefore according to this aspect of the present invention there is provided a process for the preparation of the photographic material which comprises a layer containing a PU compound, which process comprises forming a solution of a PU compound, a compound capable of being cross-linked and a photolytic cross-linking agent capable of affecting a cross-linking reaction when exposed to actinic light, exposing the solution to actinic light to effect the cross-linking reaction to form a cross-linked solid, isolating this solid and milling the solid to form particles of from 0.1 to 0.5 $\mu$m in size, dispersing the particles in a colloid binder coating solution, coating this solution on a photobase and drying the layer.

In one preferred method according to this aspect of the present invention the compound capable of being cross-linked and the cross-linking agent are the same compound and is a polymer or copolymer of a (meth)acrylate, (meth)acrylamide or vinyl ether which contains at least one maleimide group of the formula

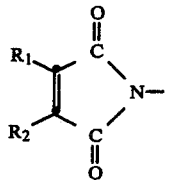

in which $R_1$ and $R_2$ are each alkyl having 1 to 4 carbon atoms, or $R_1$ and $R_2$ together with the carbon atoms to which they are bonded form a 5-membered or 6-membered carbocyclic ring.

Most preferabyl the polymer is a copolymer which comprises (1) a (meth)acrylate, (meth)acrylamide or vinyl ether derivative and which contains at least one maleimide group of the above formula.

(2) an ethylenically unsaturated comonomer containing acid groups, this comonomer being present in an amount of at least 18 percent by weight, based on the total amount of the comonomers, and, optionally, (3) at least one further ethylenically unsaturated comonomer which differs from the comonomers (1) and (2).

Preferably, comonomer (2) is acrylic acid, methacrylic acid, crotonic acid, maleic acid, fumaric acid, itaconic acid, vinylsulfonic acid, styrenesulfonic acid or a phthalic acid/(meth)acrylate half-ester.

Preferably, comonomer (3) is an alkene, a vinyl halide or vinylidene halide, (meth)acrylonitrile, an ester or amide of an $\alpha,\beta$-unsaturated acid, an aromatic or heterocyclic vinyl compound, a vinyl ester or vinyl ether or a vinyl ketone.

Most preferably comonomer (3) is an alkyl (meth)acrylate or a hydroxyalkyl (meth)acrylate.

After the photolytic reaction, the solvent is removed to yield a solid. This solid is water washed and ground to a particle size of 0.1 to 0.5 or, preferably, 0.2 to 0.3 μm.

As hereinbefore stated a suspension polymerisation reaction in the presence of a cross-linking agent may also be used.

Thus, according to this aspect of the present invention there is provided a process for preparing photographic material which comprises a layer containing a PU compound, which process comprises forming a solution of a PU compound and a cross-linking agent in a liquid ethylenically unsaturated monomer, effecting cross-linking of the monomer by adding a cross-linking initiator and raising the temperature, milling the solid to form particles of from 0.1 to 0.5 μm in size, dispersing the particles in a colloid binder coating solution, coating this solution on a photobase and drying the layer.

Preferably, however, in this aspect of the present invention before the polymerisation initiator is added to the mixture, the ethylenically unsaturated monomer solution of the PU compound and the cross-linking agent are added to an aqueous solution of a colloid suspending agent. When the cross-linking reaction is carried out the cross-linked solid forms as beads, which are insoluble in the aqueous medium. These beads can be filtered off the aqueous medium, dried out and ground.

A suitable colloid which acts as suspending agent is polyvinylpyrrolidone.

In this aspect of the present invention suitable monomers are styrene, α-methyl styrene and a (meth)acrylate. Other monomers which can also be used but which are not so effective are acrylonitrile and vinylacetate.

The preferred cross-linking agents which are liquid and soluble in the monomers are divinyl benzene and ethylene dimethacrylate.

In the photographic material prepared by the process of the present invention, the PU compound may be in any layer of the photographic material but most usually it is in a silver halide emulsion layer.

The process of the present invention is of particular use in the production of black and white silver halide material which is to be activation processed. That is to say the silver halide layer comprises a silver halide developing agent.

After such material has been imagewise exposed, it is processed by application of an aqueous alkaline processing bath. This bath activates the incorporated developing agent which develops the latent image. The most usual incorporated developing agent is hydroquinone and, as hereinbefore stated, difficulties have been experienced in incorporating this compound into a silver halide layer. In the photographic material prepared by the process of the present invention, when hydroquinone is the PU compound, the small particles which are dispersed in the silver halide emulsion contain hydroquinone. When such material is treated with an aqueous alkaline bath the particles are caused to swell and liberate the hydroquinone which then develops the latent silver image. The hydroquinone is liberated very quickly by the aqueous alkaline bath as shown in Example I which follows. However, before the application of the aqueous alkaline bath no hydroquinone migrates out of the small particles. Because of the importance of incorporating hydroquinone in a releasable form in a silver halide layer most of the following preparations relate to this aspect of the invention.

During the milling of the solid mass obtained in the process of the present invention some cross-links are broken. When hydroquinone which has a small molecular weight is occluded in the solid mass some may be liberated during the milling process. Thus, preferably the milling of the solid which contains hydroquinone is carried out in the presence of up to 1% by weight of the particles of a sulphite for example sodium metabisulphite.

Another important aspect is the incorporation of colour couplers in a silver halide layer in a medium other than an oil or oil former. In this aspect when the photographic material of the present invention which comprises in at least one silver halide emulsion layer small particles containing a colour coupler or a mixture of colour couplers is imagewise exposed and processed in an aqueous alkaline colour developing solution the oxidised colour developer is able to enter the swollen particles and there react with the colour coupler to form a dye.

However, the invention is not limited to the incorporation of hydroquinone and colour couplers in photographic material but covers the production of photographic material having any type of PU compound incorporated therein.

The photographic material of the present invention may be, for example, black and white or colour photographic material or a monochrome chromogenic material wherein a monochrome dye negative image is formed from which black and white prints may be obtained.

The silver halide emulsion used in the photographic material of the present invention may be any of the silver halides used in photographic emulsions, for example, it may be a silver chlorobromide emulsion comprising from 10% up to 90% chloride or it may be a silver bromoiodide emulsion comprising from 0.5 to 10% iodide or it may be a silver bromochloro-iodide emulsion of greatly varying halide ratios or it may be a pure silver bromide emulsion.

Any of the photobases normally used for photographic materials may be used for the photographic material of the present invention. Examples of such photobases are baryta-coated paper base, polyethylene-laminated paper base and plastics material film supports such as polyethylene terephthalate, cellulose triacetate and cellulose acetate-butyrate.

Additives often present in photographic silver halide emulsions may also be present in the silver halide emulsion used in the photographic material of the present invention, for example anti-foggants such as benzimidazoles and tetrazaindenes, wetting agents and gelatin hardening agents.

The accompanying Preparations I to XV relate to the preparations of solid particles which contain therein the developer hydroquinone, the solid particles having been prepared by solution polymerisation.

Preparation XVI relates to the preparation of solid particles which contain therein a colour coupler, the solid particles having been prepared by solution polymerisation.

Preparation XVII relates to the preparation of solid particles which contain therein an optical brightening agent (O.B.A), the solid particles having been prepared by solution polymerisation.

Preparation XVIII relates to the preparation of solid particles which contain therein an O.B.A. compound, the solid particles having been prepared by solution polymerisation followed by a photolytic cross-linking reaction.

Preparation XIX relates to the preparation of solid particles which contain therein an O.B.A compound, the solid particles having been prepared by suspension polymerisation.

Preparation XX relates to the preparation of solid particles which contain therein a colour coupler, the solid particles having been prepared by suspension polymerisation.

Preparation XXI relates to the preparation of solid particles which contain therein a colour coupler, the solid particles having been prepared by a photolytic cross-linking reaction.

Preparation XXII relates to the preparation of solid particles which contain hydroquinone, the solid particles having been prepared by solution polymerisation in a dispersed phase.

Example 1 relates to the preparation and subsequent processing of photographic materials which contain particles prepared in Preparations I to XV, that is to say particles which comprise hydroquinone.

Example II relates to the preparation and subsequent processing of photographic materials which contain particles prepared in Preparations XVI, XX and XXI, that is to say particles which comprise colour couplers.

Example III relates to the preparation and subsequent processing of photographic materials which contain particles prepared in Preparation XIX.

PREPARATION I 363 g of a copolymer of methylmethacrylate (85 parts by weight) and methacrylic acid (15 parts by weight) prepared by solution polymerisation, which was dissolved with 363 g hexamethylol melamine hexamethyl ether in 726 ml of ethanol with rapid stirring under nitrogen. To achieve complete dissolution the mixture was refluxed. The solution was acidified with 54 ml concentrated hydrochloric acid before addition of 363 g of hydroquinone. These latter additions were carried out under nitrogen and with slow stirring. When the hydroquinone had dissolved the ethanol was vacuum distilled off.

The resultant solid was removed from the reaction vessel, ground into small lumps (1–2 mm) using a mortar and pestle before heating to 110° C. in a vacuum oven to remove the last traces of solvent. Final heating varied depending on the size of lumps.

On removal from the vacuum oven the brittle solid was ground down to small particles (5–50 μm) in a Waring Blender.

A sample of the finer particles (1 g) was added to (1) water (10 ml) and (2) alcohol (99% by weight), left for 1 hour after which time the U.V. spectra of the (1) water and (2) alcohol solutions were recorded.

The peak height of 285 nm was compared to prepared standards, to quantify the percentage "free" hydroquinone. The solid was then milled.

Two milling tests were carried out one without sulphite and no pH control and one in the presence of sulphite with pH control.

First milling test: An aqueous medium which comprised 10% by weight of the solid as just prepared and 1% by weight of inert gelatin were premilled in a Silverson blender for 5 minutes. The blended mixture was then transferred to a Dyno-Mill Model KDL marketed by Glen Creston and milled for 2 hours at 4500 r.p.m. using glass beads of 1.0 to 1.5 mm. The particles produced by the milling process were then examined using a Nanosiser (Coulter Instruments) and found to have a particle size of 0.3 μm with a polydispersity of 3 to 4. The grey dispersion was carefully mixed with an equal volume of 4% aqueous gelatin solution and the mixture left overnight to set in a cold store. Next day, the dispersion was found to be stained brown and the gel could not be redissolved in water.

Second milling test: An aqueous medium which comprises 10% by weight of the solid as just prepared, 1% by weight of inert gelatin and 0.03% by weight of sodium metabisulphite was prepared with a pH-value of 6.8. The medium was blended and milled as in the first test. The average particle size after the 2 hour milling was found to be from 0.2 to 0.3 μm with a polydispersity of 3 to 4. The grey dispersion was carefully mixed with an equal volume of 4% aqueous gelatin solution and the mixture allowed to set overnight in a cold store. Next day the dispersion was found still to be grey. The gel could be redissolved in water.

PREPARATION II 482 g of a copolymer of methyl methacrylate (85 parts) and methacrylic acid (15 parts) prepared by solution polymerisation was dissolved together with 241 g of methylated urea formaldehyde resin, in 600 ml ethanol at 70° C. with stirring under nitrogen. Into this solution was added 332 g hydroquinone, once dissolved, 20 g of para-toluene sulphonic acid dissolved in a minimum volume of ethanol was added.

The solvents were distilled off under vacuum as in Preparation I. The milling and preparation of a gelatin dispersion of the solid obtained was carried out as in the second milling test of Preparation I. The average particle size was 0.2 to 0.3 μm with a polydispersity 3 to 4.

PREPARATION III 200 g of a polymer of methylmethacrylate (85 parts) and methacrylic acid (15 parts) prepared by solution polymerisation was dissolved together with 300 g bismethoxymethyl uron, under a nitrogen atmosphere in the minimum volume of alcohol (99% by weight) using heat. The solution was acidified with (40 ml) concentrated hydrochloric acid before addition of 425 g hydroquinone. After stirring to achieve complete dissolution the mixture was heated at 90° to 100° C. for 1 hour to yield a light brownish/yellow coloured gel. Further heating in a vacuum oven for one hour at 100° C. produced a brittle solid. This solid was milled to prepare a gelatin dispersion as in the second milling test of Preparation I. The average particle size was 0.3 μm. Polydispersity was 4.

PREPARATION IV 267 g of Poly(methyl methacrylate/methacrylic acid) copolymer as used in Preparation I to III, prepared by solution polymerisation was dissolved together with 267 g cellulose acetate butyrate (17% butyration and 200 g of hexamethylol melamine hexamethyl ether in 600 ml alcohol (99% by weight) with rapid stirring, under nitrogen, at 85° to 90° C. 333 g of hydroquinone were dissolved in the solution before addition of 26 g of paratoluene sulphonic acid in a minimum volume of alcohol.

The solvent was removed at an elevated temperature under vacuum to yield a solid which was milled and dispersed as in Preparation I, second milling test. The average particle size obtained was 0.3 μm with a polydispersity of 4.

PREPARATION V 326 g of poly(glyceryl maleate) prepared by condensation by polymerisation of glycerol and maleic anhydride was dissolved together with 489 g of hexamethylol melamine hexamethyl ether, in 600 ml acetone at the reflux with rapid stirring. 351 g of hydroquinone were dissolved in the solution.

The solvent was removed at an elevated temperature under vacuum. The solid was placed in an oven at 120° C. for one hour. This heat treatment was found to have increased the brittleness of the solid. The heat-treated solid was then milled and dispersed as in Preparation I, second milling test. The average particle size was 0.5 μm with a polydispersity 4 to 5.

PREPARATION VI

This preparation was similar to Preparation V except that 326 g of poly(glyceryl phthalate) prepared by condensation polymerisation of glyceryl and phthalic anhydride was used.

The solid was also heated, treated in an oven after the solvent had been removed from the solution but in this case the solid did not increase in brittleness.

A particle size of 0.3 μm with polydispersity 4 was achieved within a shorter milling time compared with the polymer in Example V.

PREPARATION VII 476 g of a terpolymer of styrene (7.0): methylmethcrylate (1.0): hydroxyethyl methacrylate (2.0 parts by weight) together with 238 g of hexamethylol melamine hexamethyl ether were dissolved in 600 ml ethanol at the reflux with rapid stirring.

333 g of hydroquinone were then dissolved in the solution. The solvent was removed under vacuum at an elevated temperature and the resultant solid milled, dispersed as in Preparation I, second milling test. The average particle size was 0.3–0.4 μm with polydispersity 3–4.

PREPARATION VIII 200 g of hydroquinone dissolved in 400 ml water was nitrogen purged for 10 minutes before adding with vigorous stirring to an aqueous solution of an urea-formaldehyde resin, 400 g (solids) in 700 ml water.

40 ml of 98% w/w formic acid solution was nitrogen purged prior to dropwise addition into the vigorously stirred hydroquinone/resin solution, gelatin occured after 5–10 minutes. Water was removed by freeze drying to leave a brittle mass which was broken down to particles of average size 1.5 cm. Heating of the solid was continued at 80° C. for 6 hours in a vacuum oven. The resultant solid was very brittle. This solid was then milled and dispersed as in Preparation I second milling test. The average particle size was 0.4 μm with a polydispersity of 4.

PREPARATION IX

A similar preparation was carried out as in Preparation VIII except that 400 g of an melamine-formaldehyde resin was used in place of the urea-formaldehyde resin. The average particle size after milling was 0.4 μm with polydispersity 4.

PREPARATION X 100 g hydroquinone dissolved in the minimum volume of acetone was nitrogen purged before adding with vigorous stirring to an acetone solution of a cyanoacrylate (200 g in 400 ml acetone). Nitrogen was passed through the solution for two hours during which time a white sticky solid was formed. Evaporation of the acetone at 60° C. resulted in a white brittle solid which was heated for an hour at 78° under vacuum. This increased the brittleness of the solid.

This solid was milled and dispersed as in Preparation I, second milling test. The average particle size was 0.3 μm with a polydispersity of 4.

PREPARATION XI 49 g and 276 g tolylene diisocyanate were stirred under nitrogen, for one hour at 20° C. and a further hour at 50° C. 175 g hydroquinone was added to the mixture with vigorous stirring. Thus, the diisocyanate was fully blocked. To assist with the dissolution of hydroquinone dry acetone was added before heating the reaction mixture to 65° C. until precipitation of the cross-linked polymer was complete and the acetone driven off.

The solid obtained was milled and dispersed as in Preparation I, second mill test. The average particle size was 0.4–0.5 μm with a polydispersity of 5.

PREPARATION XII 500 g of hexamethylol melamine hexamethyl ether were dissolved in the minimum volume of alcohol (99% by weight) under nitrogen with rapid stirring and heating. The solution was acidified with 40 ml concentrated hydrochloric acid before addition of 215 g of hydroquinone. The spirit was removed from the solution by vacuum distillation at 90° C. to leave a solid which was milled and dispersed as in Preparation I, second milling test. The average particle size was 0.3 to 0.4 μm with a polydispersity of 3 to 4.

PREPARATION XIII

This Preparation relates to the occlusion of both hydroquinone and superadditive developing agents in solid particles.

The preparation was carried out as in Preparation I except that the ingredients of the solution were:

| | |
|---|---|
| methylmethacrylate/methacrylic acid polymer | 200 g |
| hexamethylol melamine hexamethyl ether | 300 g |
| hydroquinone | 410 g |
| 1-phenyl-3-pyrazolidinone | 14 g |

The solid was ground as in Preparation I. The average particle size was 0.3 μm with a polydispersity of 3 to 4.

PREPARATION XIV

This Preparation relates to the occlusion of hydroquinones and metol in solid particles.

The Preparation was carried out as in Preparation I except that the ingredients of the solution were:

| | |
|---|---|
| methylmethacrylate/methacrylic acid copolymer | 200 g |
| hexamethylol melamine hexamethyl ether | 300 g |
| hydroquinone | 380 g |
| p-N—methyl-aminophenyl sulfate | 19 g |

The solid was ground as in Preparation I. The average particle size was 0.3 μm with a polydispersity of 3 to 4.

PREPARATION XV 200 g of a copolymer of methylmethacrylate (50 parts) and N-methoxymethylacrylamide (50 parts) was prepared by solution polymerisation in methanol (1.8 l). To the solution of the copolymer so obtained was added 90 g of hydroquinone and 50 ml of concentrated hydrochlorid acid. The methanol was then removed by distillation and the solid obtained heated at 100° C. for 30 minutes. The resultant solid was ground into small lumps using a mortar and pestle before heating at 110° C. in a vacuum oven for 1 hour. The solid was then milled as in the second milling test of Preparation I to yield particles of mean particle size 0.4 μm with a polydispersity of 4.

PREPARATION XVI

Preparation of particles containing a colour coupler of the formula

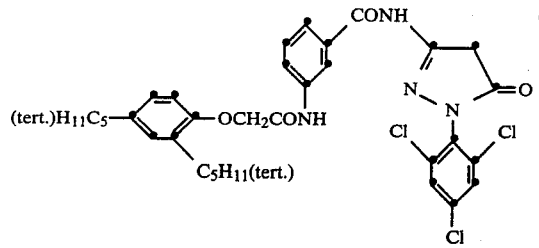

36.3, of a copolymer of methylmethacrylate (85 parts by weight) and methacrylic acid (15 parts by weight) was prepared by solution polymerisation, dissolved with 36.3 g of hexamethylol melamine hexamethyl ether in 72.6 ml of ethanol with stirring under nitrogen. 36.3 g of the colour coupler of the formula (101) was added to the polymer solution and the mixture heated to 50° to 60° C. to achieve complete dissolution. The solvent was removed by distillation to leave a solid which was heated at 80° C. for an hour prior to milling to increase the millability of the solid.

The solid was ground to particles of 5 to 50 μm in size using a Waring Blender.

Then an aqueous medium was prepared which contained 10% by weight of the particles as just prepared and 1% by weight of gelatin. This medium was premilled in a Silverson blender for 5 minutes. The blended mixture was then transferred to a Dynomill Model K.D.L. as used in preparation I and milled for 2 hours at 4500 r.p.m. using glass beads of 1.0 to 1.5 m.m. The solid particles were then separated from the glass-beads and were found to have a particle size of 0.3 μm with a polydispersity of 3 to 4.

A sample (1 g) of the milled solid was stirred in ethanol for an hour after which time the solid was filtered and the U.V. spectrum of the ethanol solution recorded. The peak height of the coupler absorptions were compared to prepared standards hence the percentage free colour was ascertained. The spectrotoscopic results obtained indicated that the substantivities of the coupler within the polymer matrix were ≧95%.

PREPARATION XVII

Preparation of particles containing an O.B.A. of the formula

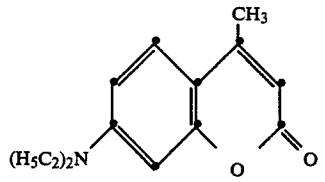

The preparation was similar to Preparation XVI using the same solution polymer but 3.63 g of O.B.A. was added instead of the colour coupler. Milling was carried out as in Preparation XVI to yield particles of size 0.3 μm with polydispersity of 3 to 4.

PREPARATION XVIII

In this preparation the dimaleimide monomer known as D.M.I. is used, the preparation of which is described in U.S. Pat. No. 4,079,041. D.M.I. is a photolytic cross-linking agent.

Into a mixture of 12.5 g of said monomer, 7.5 g methylmethacrylate and 5.0 g methacrylic acid was added 1.0 g of an O.B.A. of the formula

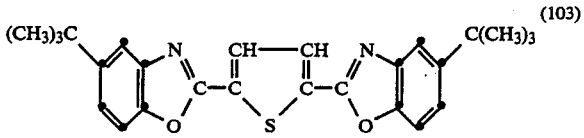

(103)

The monomer/OBA mixture was added to 137 g methylethylketone/ethylene glycol monoether (EGME) (1:1) nitrogen purged for 10 to 20 minutes and heated to 65° C. prior to addition of 0.15 g azobis-isobutyronitrile in 2.33 g butanone/EGME (1:1) in three aliquots: the second aliquot was added to the pot after 5 hours heating, the final aliquot added 5 hours after the second aliquot. Polymerisation was continued for a total of 22 hours under nitrogen. After which the polymer/PU compound solution was exposed to light whereupon further cross-linking occurred. The polymer precipitated. It was water washed and dried in a vacuum oven at 50° C.

The product was milled as in Preparation XVI. The average particle size was 0.3 μm with a polydispersity of 3 to 4.

Particles containing colour couplers can be prepared in a similar manner but particles containing hydroquinone or other developing agents are difficult to prepare using the preparation because the developing agents tend to react with the free radicals generated by the photolytic reaction.

PREPARATION XIX

Preparation involving suspension polymerisation.

Into 20 g divinyl benzene, 30 g styrene and 100 ml toluene was added 2 g of the O.B.A. of the formula (103). The monomer/O.B.A. solution of polyvinyl pyrrolidone (2.5 g in 300 ml) present as a suspension stabilizer. The reaction mixture was purged with nitrogen heated to 50° C. and stirred rapidly (800 r.p.m.). The temperature was then raised to 80° C. and 0.5 g azobis-isobutyronitrile in 5 ml toluene added. The polymerisation was continued for 5 hours under nitrogen. A solid in the form of beads precipitated.

The beaded product was filtered, washed with methanol and dried before milling. Milling was carried out as in Preparation XV. The average particle size was 0.3 μm with a polydispersity of 4.

PREPARATION XX

A similar preparation was carried out as in Preparation XIX except that 25 g of colour coupler of the formula (101) as used in Preparation XVI was dissolved in the monomers instead of the O.B.A. The average particle size was 0.3 μm with a polydispersity of 4.

Particles containing developing agents are difficult to prepare by a suspension polymerisation process as described in Preparations XVIII and XIX because the developing agents tend to react with the free radicals generated to effect polymerisation.

PREPARATION XXI

The terpolymer of Example 3 of published European patent application No. 21019 was prepared. This terpolymer comprises 60% by weight of dimethylmaleimidoethyl methacrylate, 20% by weight of methacrylic acid and 20% by weight of ethyl acrylate.

Then in subdued light 200 g of this terpolymer was dissolved in the minimum amount of an ethanol/acetone (1:1) mixture. To this terpolymer solution still in subdued light was added 100 g of the colour coupler of the formula

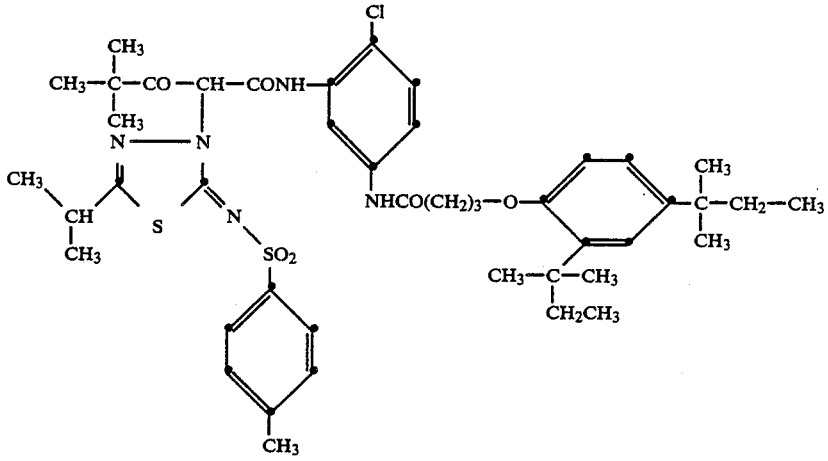

(104)

To occlude this colour coupler within the polymer matrix a solution of terpolymer and said colour coupler was then stirred under an intense light source provided by tungsten filament lamps. After 20 minutes the viscosity started to increase sharply. The ethanol/acetone solvent was then removed by vacuum distillation to leave a solid which was thoroughly dried in a vacuum oven at 50° C. for 1 hour. The solid was then milled as in Preparation XVI. The average particle size was 0.3 μm with a polydispersity of 3 to 4.

PREPARATION XXII

A flanged reaction vessel was equipped with condenser, dropping funnel, nitrogen inlet, thermometer and mechanical stirrer. A solution of sorbitan stearate ester (5.93 g) in xylene (75 ml) was added to the flask and a flowing nitrogen atmosphere established. The solution was heated to 90° C. and water (17 ml) added. A solution comprising poly(glycerylphthalate) (8.82 g), hexamethylol melamine hexamethyl ether (12.35 g), hydroquinone (14.4 g) and polyethyleneoxide laurate ester (1.58 g) in water (17 ml) was then added over a period of 2 hours. After completion of the addition, the reaction mixture was stirred for a further 4 hours at 90° C. The contents of the flask were then cooled to room temperature and the product being in particulate form was readily isolated by filtration. After drying under an air stream at room temperature, the cross-linking reaction was completed by heating under vacuum at 145° C. for 1 hour. The solid material was milled and dispersed as described in Preparation I, second milling test. This yielded a dispersion with an average particle size of 0.3 μm and a polydispersity of 4.

EXAMPLE 1

0.5 g of the solid dispersion of the hydroquinone polymer as prepared in Prepartion I is taken to produce a hydroquinone coating weight of 80 mg/dm$^2$. The coating weight required will vary according to the polymer/hydroquinone ratio. The required volume of the solid dispersion is then mixed with an aqueous gelatino silver chlorobromide emulsion to produce a silver coating weight of 25 mg/dm$^2$ and gelatin (10%) is added to produce a total gelatin coating weight of 80 mg/dm$^2$. As hardener there is added formaldehyde. This coating solution is then coated on clear subbed polyester base.

On top of this layer is then coated a gelatin nonstress 80 mg/dm$^2$, containing formaldehyde hardener and a small quantity of wetting agent.

The coatings were then processed in three alkaline activator solutions (a) 2M NaOH, pH 14, (b) $CO_3^{2\ominus}/HCO_3^{\ominus}/OH^{\ominus}$ buffer adjusted to pH 12 and (c) $CO_3^{2\ominus}/HCO_3^{\ominus}$ buffer adjusted to pH 10 and containing 0.025% 1-phenyl-3-pyrazolidinone.

The rate of silver development was then determined in the three activator solutions and the substantivity of the hydroquinone in the polymer matrix was determined by soaking part of the coating in water for thirty minutes and then processing in the standard manner. The loss in silver density of the soaked coating compared to the unsoaked coating is then related to the loss of hydroquinone.

All the photographic material was overall exposed to light.

The photographic material prepared using the hydroquinone in resin particles prepared in Preparation I to XII and XV all gave similar results.

In the solution (a) the $D_{max}$-value was obtained in from 4 to 6 seconds.

In the solution (b) the $D_{max}$-value was obtained in from 100 to 120 seconds.

In the solution (c) the $D_{max}$-value was obtained in from 2 to 3 minutes.

In the case of the hydroquinone/superadditive developing agent in resin particles of Preparations XIII and XIV similar results were obtained in the solution (a), but in the solution (b) the period to exhibit the $D_{max}$-value was reduced to 98 seconds and in the solution (c) the period to exhibit $D_{max}$-value was reduced to 100 seconds.

Two sets of photographic material from the particles obtained in Preparations I to XV were prepared. The coatings of one set were all soaked in water for 30 minutes. Then all the coatings were overall exposed and processed in solution (a). In the cases of the material made using the particles of Preparations I to IX and XII to XV the period to reach the $D_{max}$-value were all within the period 4 to 6.5 seconds. The coatings which had been soaked showed virtually the same activity as the coatings which had not been soaked when compared to their equivalents. The greatest discrepancy was less than 10% of the activity when measured by the period to reach the $D_{max}$-value.

In the case of the coatings of Preparations XIII and XIV two further sets of coatings were prepared together with three coatings of Preparation I.

All the coatings were overall exposed and processed as shown in the accompanying table.

| Coating | Solution | Period to reach the $D_{max}$-value |
|---|---|---|
| Preparation I | pH10 (as used above) | 120 seconds |
| Preparation I | pH10 + 0.025% 1-phenyl-3 pyrazolidone in solution | 100 seconds |
| Preparation I | pH10 + 0.30% p-N—Methyl-aminophenyl sulfate in solution | 100 seconds |
| Preparation XVIII | pH10 (as used above) | 100 seconds |
| Preparation XIV | pH10 (as used above) | 100 seconds |

This shows that the hydroquinone and the additional developing agent in the particles of Preparations XIII and XIV act in a manner, as if they were in the solution of the processing bath during processing.

EXAMPLE II

Photographic materials containing the colour coupler in the resin particles of Preparations XVI and XXI were compared with similar photographic materials which contained the same colour couplers as oil dispersions.

(a) Preparation of the colour coupler of the formula (101) as an oil dispersion.

A dispersion was prepared using a colloid mill which comprised:

| | |
|---|---|
| Colour coupler of the formula (101) | 6 g |
| Tri-isopropylphenyl phosphate | 7.5 g |
| Gelatin | 4 g |
| Ethylacetate | 5 g |
| Sodium alkyl naphthalene sulphonate | 10 ml |
| Nonylphenol ethylene oxide condensate | 0.5 g |
| Water to | 100 ml |

An exactly similar dispersion was also prepared which contained 6 g of colour coupler of the formula (104) instead of colour coupler of the formula (101).

Photographic materials $A_1$ and $B_1$ were then prepared from these two dispersions by taking sufficient of the two dispersions and adding them with hand stirring at 40° C. to an aqueous gelatino silver halide emulsion so that when the emulsion was coated on cellulose triacetate base and dried the coating weights of each ingredient per 1 dm$^2$ were as follows:

| | |
|---|---|
| Gelatin | 41 mg |
| Silver iodobromide | 40 mg (of silver) |
| Colour coupler of formula (101) or (104) | 24 mg |

Over the silver halide emulsion layer there was coated a gelatin protective layer.

These are the comparative photographic materials.

(b) Preparation of photographic materials $A_2$ and $B_2$ according to the present invention.

Sufficient quantity of the resin particles prepared in Preparation XVI and Preparation XXI were added using a Silverson blender at 40° C. to an aqueous gelatinc silver halide emulsion so that when the emulsion is coated on cellulose triacetate base and dried the coating weights of each ingredient per 1 $dm^2$ are as follows:

| | |
|---|---|
| Gelatin | 41 mg |
| Silver iodobromide | 40 mg (silver) |
| Colour coupler of formula (101) or (104) | 24 mg |

Over the silver halide emulsion layer there was coated a gelatin protective layer.

After exposing overall the four photographic materials they were processed as follows at 37.8° C.:

| | | |
|---|---|---|
| 1. Colour developing | 3¼ | minutes |
| Developer bath: | | |
| Potassium carbonate | 37.5 | g |
| Sodium sulphite (anhydrous) | 4.25 | g |
| Potassium iodide | 2.0 | mg |
| Sodium bromide | 1.3 | g |
| Hydroxylamine sulphate | 2.0 | g |
| 4-(N—ethyl-N—hydroxyethylamino)-2-methylaniline hydrogen sulphate | 4.75 | g |
| Diethylenetriamine penta-acetic acid | 2.2 | g |
| Water to | 1 | l |
| 2. Bleaching | | |
| Bleach bath: | 6½ | minutes |
| Ammonium bromide | 150 | g |
| Ammonium salt of the iron-III-complex of ethylenediamine tetra-acetic acid (1.47 M) | 175 | ml |
| Acetic acid | 10 | ml |
| Sodium nitrate | 35 | g |
| Water to | 1 | l |
| 3. Washing | 3¼ | minutes |
| 4. Fixing | | |
| Fix bath: | 5 | minutes |
| Ammonium thiosulphate (58.6% solution) | 162 | ml |
| Diethylenetriamine penta-acetic acid | 1.25 | g |
| Sodium metabisulphite (anhydrous) | 12.4 | g |
| Sodium hydroxide | 2.4 | g |
| Water to | 1 | liter |
| 5. Washing | 3½ | minutes |
| 6. Stabilising | | |
| Stabilising bath: | 5 | minutes |
| Formaldehyde (35%) | 5.0 | ml |
| Sodium alkyl aryl polyether sulphate | 1 | ml |
| Water to | 1 | liter |

The colour densities obtained in the four coatings were then determined.

TABLE

| Coating | Density |
|---|---|
| Material $A_1$ | 1.63 |
| Material $B_1$ | 0.93 |
| Material $A_2$ | 1.45 |
| Material $B_2$ | 0.79 |

This shows that the oxidised colour developing agent had been able to penetrate the resin and couple with the colour couplers present in the resins as prepared in Preparations XVI and XXI.

Thus, the results according to the Table clearly demonstrate that processing of the inventive material leads to good colour densities in the final image.

However, the density figures obtained cannot be interpreted as comparative figures in view of the colour density formed in usual photographic materials where the colour couplers are dissolved in oil before coating, since it is evident, that when more colour coupler in present in the resin the colour density (figures) will increase.

This means, that depending on its use a wide range of colour densities can be provided with the inventive material without being dependent on oil as solvent for the colour couplers.

EXAMPLE III

This example is concerned with the use of polymer-occluded optical brightening agents. Coatings of the polymer occluded compound of the formula (103) described in Preparation XIX and of an oil dispersion of this compound were prepared and analysed as described below.

The compound of the formula (103) was prepared as an oil dispersion as follows: The compound of the formula (103) (0.1 g) was dissolved in a mixture of tri-isopropylphenylphosphate (4.0 g) and ethyl acetate (3.0 g). This solution was then dispersed in a solution of gelatin (0.6 g) and sodium alkyl naphthalene sulphonate (0.2 g) in water (18 ml) using a colloid mill. The ethyl acetate was then removed to yield a 0.4% (wt/wt.) oil dispersion of compound of the formula (103).

Coating solutions were prepared by adding appropriate quantities of a gelatin solution and formalin to said polymer-occluded O.B.A. solid dispersion (c.f. Preparation XIX) and O.B.A. oil dispersion. These solutions were then coated on polyester base to give identical coating weights, which were:

(i) gelatin = 83 mg $dm^{-2}$ (ii) compound of the formula (103) = 0.8 mg $dm^{-2}$ The two coatings were analysed for their fluorescence using a Beckman Spectrofluorimeter. The coatings were sensitised by U.V. irradiation at 380 nm and the fluorescence emission measured at an angle of 90° to the incident sensitising radiation. Fluorescence emission was measured in the wavelength range 400–600 nm and both coatings showed a maximum at about 435 nm. The fluorescence yields (arbitrary units), corrected for base fluorescence, were:

(i) Polymer-occluded O.B.A. = 31

(ii) Oil-dispersed O.B.A. = 48

This shows, that with the inventive material also good brightening effects can be obtained.

In this example, too, the fluorescence yields do not represent comparative data. Increasing the amount of O.B.A. in the polymer particles leads to increased fluorescence yields.

Thus, according to the present invention, photographic materials with varying fluorescence emission can be provided with the advantage of eliminating the need for oil as solvent for the O.B.A.

What is claimed is:

1. A process for the preparation of a photographic material comprising at least one silver halide emulsion layer and which contains in at least one layer a PU compound selected from the group consisting of developing agents, colour couplers, optical brightening agents, filter dyes or acutance dyes which process comprises forming a solution of a PU compound, a compound capable of being cross-linked and a cross-linking agent for the cross-linkable compound, effecting cross-linking of the cross-linkable compound to form a cross-linked solid, isolating the solid and milling the solid to form particles of 0.1 to 0.5 μm in size, dispersing the particles in a colloid binder coating solution, coating this solution on a photobase and drying the layer.

2. A process according to claim 1 wherein the colloid binder coating solution is a gelatino silver halide emulsion.

3. A process according to claim 1 wherein the developing agent is hydroquinone.

4. A process according to claim 1 which comprises forming a solution of a PU compound, a compound capable of being cross-linked and a cross-linking agent for said cross-linkable compound effecting cross-linking by raising the temperature of the dispersion to drive off the first liquid and form a cross-linked solid in particulate form, optionally continuing the heating to effect a higher cross-link density, isolating the solid, milling the solid to form particles in a colloid binder coating solution, coating this solution on to a photobase and drying the layer.

5. A process according to claim 4 wherein the first liquid is water and the second liquid is xylene, toluene or tetralin.

6. A process according to claim 1, which comprises preparing an aqueous or organic solvent solution of a polymer or copolymer which has pendant —OH, —$CONH_2$, —COOH or

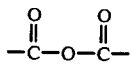

groups and a compound capable of cross-linking with the polymer or copolymer in acid conditions, acidifying the solution and dissolving in the solution the PU compound, effecting cross-linking by raising the temperature of the solution to drive-off the solvent and form a cross-linked solid, optionally continuing the heating to effect a higher cross-link density, milling the solid to form particles of from 0.1 to 0.5 μm in size, dispersing the particles in a colloid binder coating solution, coating this solution on to a photobase and drying the layer.

7. A process according to claim 4, which comprises preparing a solution of a polymer or copolymer which has pendant —$CONH_2$, —OH, —COOH or

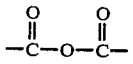

groups and a compound capable of cross-linking with the polymer or copolymer in acid conditions in a first liquid, acidifying the solution an dissolving in the solution the PU compound, dispersing this solution in an immiscible second liquid which has a higher boiling point than said first liquid, effecting cross-linking by raising the temperature of the dispersion to drive off the first liquid and form a cross-linked solid in particulate form, optionally continuing the heating to effect a higher cross-link density, isolating the solid, milling the solid to form particles in a colloid binder coating solution, coating this solution on to a photobase and drying the layer.

8. A process according to claim 4, wherein the solid left after all the solvent has been driven-off is heated for a further period of time before it is milled.

9. A process according to claim 1 which comprises forming a solution of a PU compound, a compound capable of being cross-linked and a photolytic cross-linking agent capable of effecting a cross-linking reaction when exposed to actinic light, exposing the solution to actinic light to effect the cross-linking reaction to form a cross-linked solid, isolating this solid and milling the solid to form particles of from 0.1 to 0.5 μm in size, dispersing the particles in a colloid binder coating solution, coating this solution on a photobase and drying the layer.

10. A process according to claim 9 wherein the compound capable of being cross-linked and the cross-linking agent is the same compound and is a polymer or copolymer of a (meth)acrylate, (meth)acrylamide or vinyl ether which contains at least one maleimide group of the formula

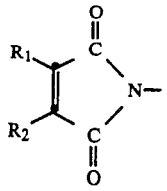

in which $R_1$ and $R_2$ are each alkyl having 1 to 4 carbon atoms, or $R_1$ and $R_2$ together with the carbon atoms to which they are bonded form a 5-membered or 6-membered carbocyclic ring.

11. A process according to claim 10 wherein the polymer is a copolymer which comprises (1) a (meth)acrylate, (meth)acrylamide or vinyl ether derivative and which contains at least one maleimide group of the formula according to claim 10, (2) an ethylenically unsaturated comonomer containing acid groups, this comonomer being present in an amount of at least 18 percent by weight, based on the total amount of the comonomers, and, optionally, (3) at least one further ethylenically unsaturated comoner which differs from the comonomers (1) and (2).

12. A process according to claim 1 which comprises forming a solutin of a PU compound and a cross-linking agent in a liquid ethylenically unsaturated monomer, effecting cross-linking of the monomer by adding a cross-linking initiator and raising the temperature, milling the solid to form particles of from 0.1 to 0.5 μm in size, dispersing the particles in a colloid binder coating solution, coating this solution on a photobase and drying the layer.

13. A process according to claim 12 wherein before the polymerisation initiator is added to the mixture the monomer solution of the PU compound and the cross-linking agent are added to an aqueous solution of a colloid suspending agent.

14. Photographic material prepared according to claim 1.

* * * * *